US009342971B2

(12) United States Patent
Riley et al.

(10) Patent No.: US 9,342,971 B2
(45) Date of Patent: May 17, 2016

(54) DURESS ALARM SYSTEM FOR CLOTHING

(75) Inventors: James Riley, Fairport, NY (US); Steve Markham, Rochester, NY (US)

(73) Assignee: Robert Bosch GmbH, Stuttgart (DE)

( * ) Notice: Subject to any disclaimer, the term of this patent is extended or adjusted under 35 U.S.C. 154(b) by 966 days.

(21) Appl. No.: 12/334,821

(22) Filed: Dec. 15, 2008

(65) Prior Publication Data

US 2010/0148975 A1 Jun. 17, 2010

(51) Int. Cl.
*G08B 21/00* (2006.01)
*G08B 21/02* (2006.01)
*A41D 1/00* (2006.01)

(52) U.S. Cl.
CPC ..... *G08B 21/0297* (2013.01); *A41D 1/002* (2013.01)

(58) Field of Classification Search
CPC ..... A41D 1/002; G08B 21/0297
USPC ..... 340/573.1, 574, 665, 571; 482/121, 482/124; 116/84
See application file for complete search history.

(56) References Cited

U.S. PATENT DOCUMENTS 4,788,532 A 11/1988 Maldonado
5,195,752 A 3/1993 Reeves et al.
5,802,607 A 9/1998 Triplette
5,906,004 A 5/1999 Lebby et al.
6,080,690 A 6/2000 Lebby et al.
6,267,730 B1 7/2001 Pacunas
6,360,615 B1 3/2002 Smela
7,660,692 B2 * 2/2010 Van Albert et al. ..... 702/127
2002/0011934 A1 * 1/2002 Cacioli et al. ..... 340/604
2003/0193404 A1 * 10/2003 Joao ..... 340/825.71
2003/0214408 A1 * 11/2003 Grajales et al. ..... 340/573.1
2006/0041345 A1 * 2/2006 Metcalf ..... 701/33
2006/0053534 A1 * 3/2006 Mullen ..... 2/456
2006/0119468 A1 * 6/2006 Van Swaay ..... 340/5.1
2006/0258916 A1 11/2006 Pietersen
2007/0260407 A1 * 11/2007 Van Albert et al. ..... 702/57
2007/0299325 A1 12/2007 Farrell et al.
2009/0235761 A1 * 9/2009 Song ..... 73/862.59

* cited by examiner

*Primary Examiner* — Mark Rushing

(74) *Attorney, Agent, or Firm* — Michael Best & Friedrich LLP

(57) ABSTRACT

An article of clothing includes a sensor attached to a fabric body for detecting forces applied to the fabric body. A processor is attached to the fabric body and is communicatively coupled to the sensor. The processor receives signals from the sensor, analyzes the signals, and discerns therefrom whether a physical attack is occurring on a wearer of the fabric body. The processor emits a distress signal if it is discerned that an attack is occurring.

20 Claims, 3 Drawing Sheets

DURESS ALARM SYSTEM FOR CLOTHING

BACKGROUND

1. Field of the Invention

The present invention relates to personal security systems, and, more particularly, to wearable personal security systems.

2. Description of the Related Art

It is known for personal panic alarm devices to be worn on a person's body, such as on a necklace or stored in a pants pocket. In the event that the person is attacked, believes he will be attacked, or becomes disabled, the person may press a button on the device in order to cause a radio frequency signal to be sent to a monitoring station so that assistance may be summoned. However, in the case of protection against a bodily attack, it is often difficult for an individual to predict a debilitating attack and then initiate a call for assistance. Pressing the button of the device after the attack has begun may be even more difficult.

As described above, present personal alarm devices depend upon the ability of the wearer to press the panic button at an appropriate time, as no current system is adequately configured to provide complete automatic decision making abilities based on detected attack forces. Further, current devices are not able to automatically place duress calls to a third party in the event of an attack. Another particular problem with prior art devices is that they are not able to measure pulling or grabbing forces and are not able to use such measured forces as a criteria for duress notification.

What is neither disclosed nor suggested by the art is an apparatus that integrates force measurement devices within or on a piece of clothing with the ability to call for help in response to the force measurements.

SUMMARY OF THE INVENTION

The present invention is directed to the use of force sensing technology integrated within a particular garment where a force might be expected in an attack scenario. As a force is applied, force transducer electronics issues a signal to an electronic signal conditioning circuit. A microcontroller uses algorithms for determining the type of force applied at the garment. If the force is deemed a duress level force, a distress signal is transmitted via an RF transmitter to a cell phone or police/military radio. The level of force being applied to the garment is analyzed to determine whether the force represents a duress scenario. Pulling or grabbing, as sensed by a strain gauge, a transducer or a matrix of capacitive sensors, may be criteria for duress notification.

The invention employs a technology whereby a plurality of sensing technologies can be integrated into clothing or cloth. Activation of these sensors by some predetermined external force can cause signals to be transmitted to a communications medium or device that can transmit a duress message as a call for help. This communication process may be totally unassisted by the individual wearing such a garment.

The apparatus of the invention may sense a force created by gun shot, blunt force from a weapon, hand-to-hand combat or any other predetermined force resulting from an attack. This device of the invention may also detect a grabbing force. Once the force has been measured, a communication regarding the force may be passed along via wired or wireless means to a more sophisticated communication device such as a police radio, cell phone, military radio, or any other means that may enable a call for help to be transmitted.

The invention may employ strain gauge technologies that are embedded into the fabric for sensing force to a garment or article of clothing. The invention may also include a matrix of capacitive sensors that change capacitance at the site of the force. More generally, any technology whose electrical characteristics are a function of forces exerted on the technology may be employed in the invention.

Whatever the technology, an electronic force signal produced thereby may be representative or indicative of the force exerted on the technology. Once a force signal having a magnitude above a particular threshold level is detected, the force signal may be analyzed for more specific magnitude, frequency and/or duration characteristics. Based on the analyzed characteristics, the measured force may be categorized into different threat levels. Based on the particular threat level of a measured force, a short range communication to a longer range device such as a cellular telephone, police radio, military radio, or other long range communication medium may be initiated.

The force-sensing technology, such as force transducer electronics, may be integrated into a particular garment on which a force might be expected in an attack scenario. As a force is applied to the garment, the force transducer electronics may issue a signal to an electronic signal-conditioning circuit including a microcontroller. The microcontroller may run various algorithms for determining the type of force applied at the garment. If the force is deemed a duress-level force, a signal indicating a duress condition may be transmitted via a low power RF transmitter to a standard communication device such as a cell phone, police or military radio. The communications may result in a duress message being transmitted to a third party who will be able to assist or call for help.

The invention comprises, in one form thereof, an article of clothing including a sensor attached to a fabric body for detecting forces applied to the fabric body. A processor is attached to the fabric body and is communicatively coupled to the sensor. The processor receives signals from the sensor, analyzes the signals, and discerns therefrom whether a physical attack is occurring on a wearer of the fabric body. The processor emits a distress signal if it is discerned that an attack is occurring.

The invention comprises, in another form thereof, a personal alarm arrangement including a sensor attached to a fabric body for detecting forces applied to the fabric body. A processor is attached to the fabric body and is communicatively coupled to the sensor. The processor receives signals from the sensors and discerns from the signals whether a wearer of the fabric body is being assaulted. If it is discerned that the wearer is being assaulted, then the processor emits a radio frequency distress signal. A radio frequency transceiver receives the distress signal and responds thereto by transmitting a radio frequency alarm signal to a monitoring agent. The alarm signal has a greater power than the distress signal.

The invention comprises, in yet another form thereof, a personal alarm method including providing an article of clothing having a fabric body with a sensor and a processor. The sensor is used to detect a force applied to the fabric body. Signals indicative of the force are transmitted from the sensor. The signals are received at the processor and the processor discerns from the signals whether a wearer of the fabric body is being assaulted. The processor emits a radio frequency distress signal if it is discerned that the wearer is being assaulted. The distress signal is received at a radio frequency transceiver and the transceiver responds thereto by transmitting a radio frequency alarm signal to a monitoring agent. The alarm signal has a greater power than the distress signal.

An advantage of the present invention is that it is able to analyze the level of force being applied to a garment and determine whether the force represents a duress scenario.

Another advantage is that, if it is determined that a sensed force represents a duress force, it is possible to automatically send any of a number of different messages to someone who could assist.

Yet another advantage is that it includes measured pulling or grabbing forces as a criterion for duress notification.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
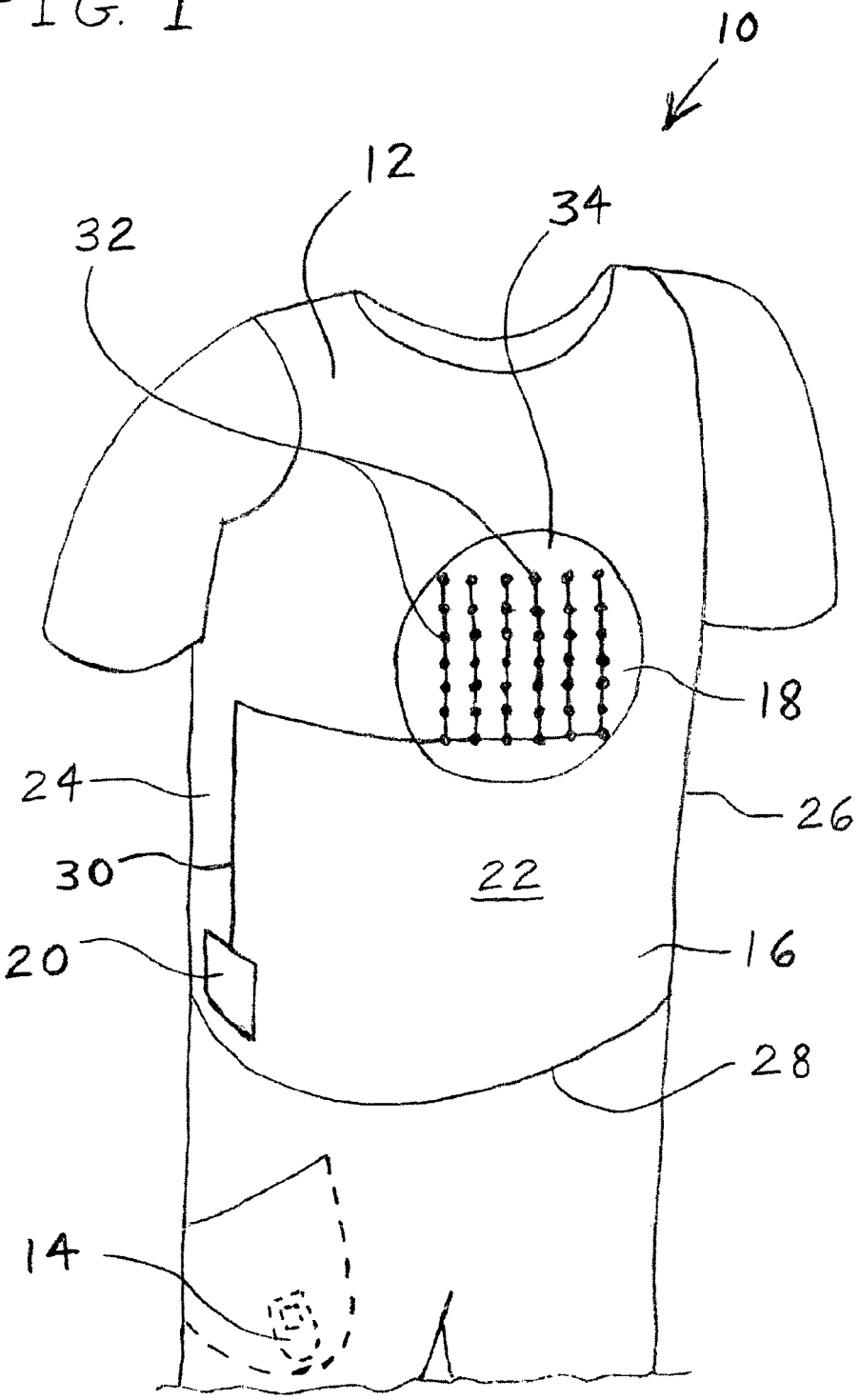
FIG. 1 is a perspective view of one embodiment of a personal alarm arrangement of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Referring now to the drawings, and particularly to FIG. 1, there is shown one embodiment of a personal alarm arrangement 10 of the present invention including an article of clothing 12 in the form of a shirt and a radio frequency transceiver 14 in the form of a mobile telephone. Shirt 12 includes a fabric body 16, a sensor matrix 18 and processing electronics 20. Fabric body 16 includes a front side 22, a right lateral side 24, a left lateral side 26, and a bottom hem 28. Body 16 may be formed of any conventional clothing fabric, such as cotton, polyester, or a synthetic blend, for example. Although sensor matrix 18, processing electronics 20 and an electrically conductive cable 30 interconnecting matrix 18 and electronics 20 are visible in FIG. 1 for illustrative purposes, it is to be understood that, in one embodiment, matrix 18, electronics 20 and/or cable 30 may be attached to body 16 such that they are not visible to a casual observer viewing the outer surface of shirt 12.

Sensor matrix 18 may be interwoven into body 16, stitched or adhered to an inside surface of body 16, or otherwise attached to body 16. Sensor matrix 18 may be attached to front side 22 of fabric body 16.

Sensor matrix 18 may include a two-dimensional matrix of individual sensors 32 mounted on a flexible, electrically insulating pad 34, which is circular in the embodiment shown in FIG. 1. Pad 34 may be formed of a material that is easily adhered to fabric body 16. In the embodiment of FIG. 1, there are seven rows and six columns of sensors 32. However, the matrix may have any number of columns and any number of rows. Further, in other embodiments, the matrix is not organized with sensors aligned in vertical columns and horizontal rows but rather is organized in a staggered, possibly repeating pattern in which a given row is not identical to adjacent rows and/or a given column is not identical to adjacent columns.

Each sensor 32 may be in the form of any electrical device having a detectable characteristic that changes when force is applied thereto. In specific embodiments, sensors 32 are in the form of strain gauges, transducers and/or capacitive sensors.

In embodiments in which sensors 32 are of a type that are able to sense force in only a limited number of directions, sensors 32 may be oriented in different directions on pad 34. Thus, with sensors 32 being oriented in a variety of directions, matrix 18 may be able to sense forces exerted on matrix 18 in a variety of directions. For instance, matrix 18 may be able to sense an attacker grabbing matrix 18; pulling on any part of body 16 such that a stretching force is exerted on matrix 18; striking matrix 18; and/or pressing on matrix 18.

The electrical connections between sensors 32 and electronics 20 are illustrated only schematically in FIG. 1 at 30. Each sensor 32 may be individually directly connected to electronics 20 via two respective dedicated electrical conductors. That is, eighty-four electrical conductors may be utilized for the forty-two sensors 32. However, the electrical connections between sensors 32 and electronics 20, and/or between sensors 32, that are provided in a particular embodiment may depend upon the type of sensors 32 that are employed. For instance, some of sensors 32 may be connected in series and/or groups of sensors 32 may be connected in parallel.

Cable 30 is shown in FIG. 1 as being confined to a single strand or conduit that has a first leg extending horizontally from sensor matrix 18 and a second leg extending vertically down to electronics 20. In another embodiment, however, a plurality of electrical conductors interconnecting electronics 20 and sensor matrix 18 are not bundled in a single cable, but rather are evenly spaced from one another within the fabric material of body 16 such that the individual conductors are not easily seen. That is, the conductors individually may not be visible at all to a casual observer, or may appear to part of the fabric material.

Processing electronics 20 may be interwoven into body 16, stitched or adhered to an inside surface of body 16, or otherwise attached to body 16. Processing electronics 20 may be attached to either of lateral sides 24, 26 of fabric body 16.

Figure 2:
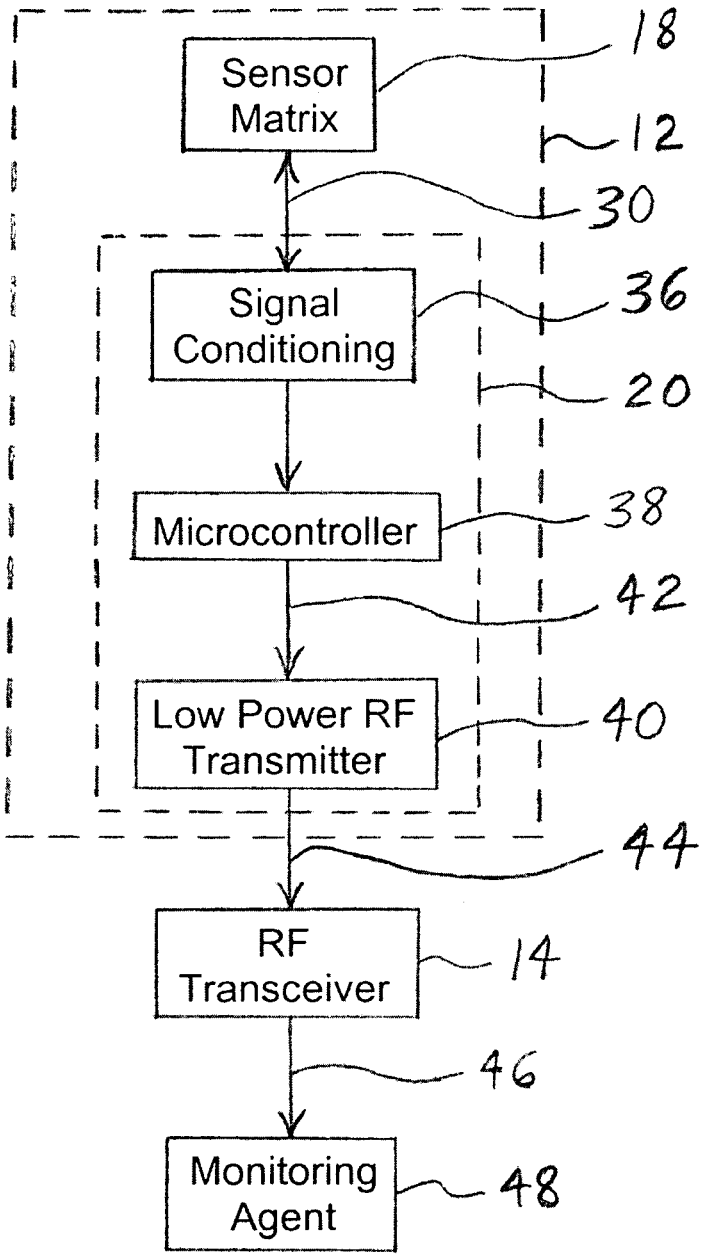
FIG. 2 is a block diagram of the personal alarm arrangement of FIG. 1 in communication with a remote monitoring agent.

As shown in FIG. 2, processing electronics 20 may include a signal conditioning circuit 36, a microcontroller 38, and a low power radio frequency transmitter 40. Processing electronics 20 may also include a replaceable battery (not shown) that may provide operating power to circuit 36, microcontroller 38 and transmitter 40. The battery may also apply voltage to sensor matrix 18 such that the electrical characteristics of sensors 32 may be measured by signal conditioning circuit 36.

Signal conditioning circuit 36 generally receives the sensor signals from each of sensors 32 and transforms the sensor signals into a form that can be used by microcontroller 38. In one embodiment, signal conditioning circuit 36 converts the analog sensor signals from sensors 32 into digital form that can be received and processed by microcontroller 38. In addition, or alternatively, circuit 36 may serialize the sensor signals that circuit 36 receives in parallel from various sensors 32. The serializing of the sensor signals may include time-domain multiplexing of the digitized signals from sensors 32. The multiplexed sensor signals may include identifications of the particular sensor, or of the location of the sensor, from which each respective portion of the time-domain multiplexed sensor signal originates. Moreover, signal conditioning circuit 36 may convert the sensor signals into signals having voltages and currents that are appropriate for inputting to microcontroller 38.

Microcontroller 38 may generally receive the sensor signals from signal conditioning circuit 36 and may decide based thereon whether or not a wearer of shirt 12 is being physically attacked or assaulted by another human being. Microcontroller 38 may run an algorithm to make this decision, and the algorithm may utilize a formula and/or a lookup table. In one embodiment, microcontroller 38 may decide that an assault is occurring if two or more consecutive sensor signals indicate a force greater than a threshold level of force is being exerted on sensor matrix 18. In another embodiment, wherein adjacent sensors 32 are perhaps no more than about three to four inches apart, a sensor reading above a threshold level may be confirmed by at least a second adjacent sensor reading exceeding the threshold before microcontroller 38 decides that an attack is occurring. Many different variations of the criteria used to decide whether an attack is occurring are possible within the scope of the invention. In one embodiment, sensor force readings from a single sensor or from a group of adjacent sensors during a preceding time period of less than ten seconds must average above a threshold level in order for microcontroller 38 to decide that an attack is occurring.

In another embodiment, sensors are provided with different orientations in order to sense pulling forces in a certain direction or along a certain axis. Thus, confirmation of a sensor reading above a threshold level may be provided by a sensor with a similar orientation rather than by an adjacent sensor. In another embodiment, a number of sensors that have similar orientations and that are disposed within a certain distance of each other must each sense a force above a threshold level in order for microcontroller 38 to decide that an attack is occurring.

In another embodiment, rather than deciding that an assault is occurring when a measured force exceeds a threshold level of force, microcontroller 38 determines a steady state level of force on sensors 32 and decides an assault is occurring when a measured force exceeds the steady state level of force by a threshold amount. This embodiment may be particularly desirable when shirt 12 fits tightly on the wearer, such as an undershirt. Because of the tightness of the undershirt, a significant pulling force may be placed on sensors 32 during normal wearing. Thus, in order to avoid falsely deciding that an attack is occurring, microcontroller 38 may require that the measured force exceed the steady state measured force by at least a predetermined amount. In this embodiment too, the measured force exceeding the steady state measured force by at least a predetermined amount may need to be observed for a certain period of time or in a number of consecutive readings, or may need to be confirmed by another sensor, before the microcontroller decides that an assault is occurring.

Regardless of the criteria or algorithm used to arrive at the decision, once microcontroller 38 decides that an assault is occurring, microcontroller 38 may send a signal to transmitter 40, as indicated at 42. Signal 42 may be in the form of applying power to transmitter 40, thereby enabling transmitter 40 to operate.

In response to receiving signal 42 from microcontroller 38, transmitter 40 may transmit a low power radio frequency distress signal, as indicated at 44. In one embodiment, the distress signal has a transmission range of less than one mile. The distress signal may be received by any capable radio frequency transceiver that is within the transmission range of the distress signal. The distress signal may have a frequency that makes the signal receivable by a variety of potential RF transceivers, such as a police radio, a military radio, or a cellular mobile telephone 14. In the embodiment shown in FIG. 1, an RF transceiver in the form of a cellular mobile telephone 14 is disposed in the pants pocket of a wearer of shirt 12.

In another embodiment, transmitter 40 transmits the distress signal continuously with alternating frequencies so that a greater number of RF transceivers, which may be tuned to receive different frequencies, may potentially receive the signal. After transmitter 40 has scanned through a range of transmission frequencies for the distress signal, transmitter 40 may start again at the beginning of the range of transmission frequencies and may repeatedly cycle through the range of transmission frequencies until battery power has been exhausted.

The distress signal may have a specific format that makes the signal recognizable by any of these potential RF transceivers as a distress signal. In one embodiment, the distress signal is transmitted with a dedicated frequency that is used only by distress signals. In another embodiment, a user's cell phone is programmed to recognize the frequency emitted by transmitter 40 as being a distress signal, even if the frequency is not one that is dedicated to only distress signals. Because of the likely close proximity of the user's cell phone to the user during the assault, the signal strength of the received distress signal may be relatively high. Thus, the cell phone may use the high signal strength as a criterion to recognize the signal as a distress signal, rather than as a non-distress signal from an extraneous source that happens to be using the same frequency. That is, the cell phone may require that a received signal have at least a threshold amplitude at the programmed frequency in order to recognize the received signal as a distress signal.

Microcontroller 40 may be programmed to include the owner's identification information, such as the owner's name, address and/or cell phone number, in the duress signal. The identification information may be digitally encoded in the duress signal and/or the identification information may be provided in a prerecorded or voice synthesized message in the duress signal that may be audibly heard at transceiver 14 and/or at monitoring agent 48.

Once the RF transceiver 14 has recognized the incoming signal as a distress signal, transceiver 14 may transmit a radio frequency alarm signal, as indicated at 46, to a monitoring agent 48. The alarm signal transmitted by transceiver 14 may be of a higher power and may have a greater transmission range than the distress signal transmitted by transmitter 40. Similarly to the distress signal, the alarm signal may have a dedicated frequency that enables monitoring agent 48 to recognize the incoming signal as an alarm signal.

In embodiments in which transceiver 14 is in the form of a cell phone, the alarm signal may be in the form of a standard cellular telephone call to monitoring agent 48. In one embodiment, the cellular telephone call is placed to the well known emergency number 911. The 911 call center may determine the geographic location of the transmitting cell phone 14 via known technology. Cell phone 14 may be programmed to transmit a prerecorded or voice synthesized message that is heard by the 911 human operator who receives the call. The voice message may state that the owner of the calling cell phone is being assaulted and that police and/or an ambulance should be sent to the location of the cell phone, for example.

In embodiments in which transceiver 14 is in the form of a police radio or military radio, the shirt owner's identification information included in the received distress signal may be audibly played back on a speaker of the police or military radio. In addition or alternatively, the owner identification information may be converted into text and presented on a display screen of the police or military radio. A human operator of the police or military radio may then be able to act upon the owner identification information that he has audibly or visually received on the radio. For instance, the human operator of the radio may radio or call the 911 call center, a local police station and/or an ambulance in order to summon assistance for the wearer of shirt 12. If the operator of radio transceiver 14 is a policeman or medical professional himself, he may respond to the distress signal by calling the shirt wearer's cell phone number to verify his location, or by reporting to the shirt wearer's place of residence. It is also possible for the operator of radio transceiver 14 to call 911 or some other authority ascertain the current location of the identified cell phone number, regardless of whether the shirt wearer's cell phone is functioning as a redundant or secondary RF transceiver 14. Techniques for determining the current location of a cell phone are well known in the art.

In embodiments in which transceiver 14 is in the form of a police radio or military radio, the shirt owner's identification information included in the received distress signal may also be automatically transmitted by transceiver 14 to monitoring agent 48. This identification information may be included in alarm signal 46 that is transmitted to monitoring agent 48.

Monitoring agent 48 may be in the form of a human agent or an automated agent. Examples of human agents are operators of 911 call centers and police station and hospital switchboard operators. However, automated agents may be provided that recognize the incoming signal as an alarm signal, such as by the frequency of the signal and/or the signal's content. Such automated agents may verify that the incoming signal is an alarm signal; extract the owner identification information from the incoming signal; and transmit the identification information to a human agent, such as a 911 operator or police or hospital switchboard operator. The transmission from the automated agent to the human agent may also include a notice that the identification information is associated with an alarm signal that requires an immediate response. The transmission from the automated agent to the human agent may be an air-borne radio frequency transmission or may be carried by land lines, such as standard telephone lines.

During setup, processing electronics 20 may include a pushbutton (not shown) that when pushed causes transmitter 40 to transmit a sample duress signal. Cell phone transceiver 14 may be programmed to scan a limited frequency range to detect the duress signal and thereby learn the transmission frequency of the duress signal.

During use, a wearer of shirt 12 may be physically attacked by another human. Sensor matrix 18 may not be visible to the attacker, and the attacker may grab, pull on, twist, and/or strike a portion of the shirt's fabric body 16 on which matrix 18 is mounted. Processing electronics 20 may apply a voltage to matrix 18 via cable or cables 30 such that some electrical characteristic (e.g., resistance or capacitance) of individual sensors 32, or of the entire matrix or network of sensors 32, may be measured by signal conditioning circuit 36.

Signal conditioning circuit 36 may periodically monitor the electrical characteristics of sensors 32 or of matrix 18 as a whole. When circuit 36 senses a change in the electrical characteristics of sensors 32 or of matrix 18 that is consistent with elevated forces being exerted on sensors 32, then microcontroller 38 may decide that a physical attack on the wearer of shirt 12 is occurring. Microcontroller 38 may then cause a low power distress signal 44 to be transmitted from RF transmitter 40 to RF transceiver 14. In turn, RF transceiver 14 may transmit a higher power alarm signal 46 to monitoring agent 48. If monitoring agent 48 is a human entity, then monitoring agent 48 may summon assistance for the wearer of shirt 12 from police and/or medical personnel. If, however, monitoring agent 48 is an automated entity, then monitoring agent 48 may notify human personnel who may then summon help from the appropriate parties. Regardless of whether monitoring agent 48 is human or non-human, the location of the wearer of shirt 12 may be ascertained by known techniques to determine the location of a transmitting cell phone 14; the wearer's place of residence; the known location of a police or military radio receiving the duress signal; and/or the location of the cell phone having the identified standard ten digit number including area code, which may be determined by known techniques.

Figure 3:
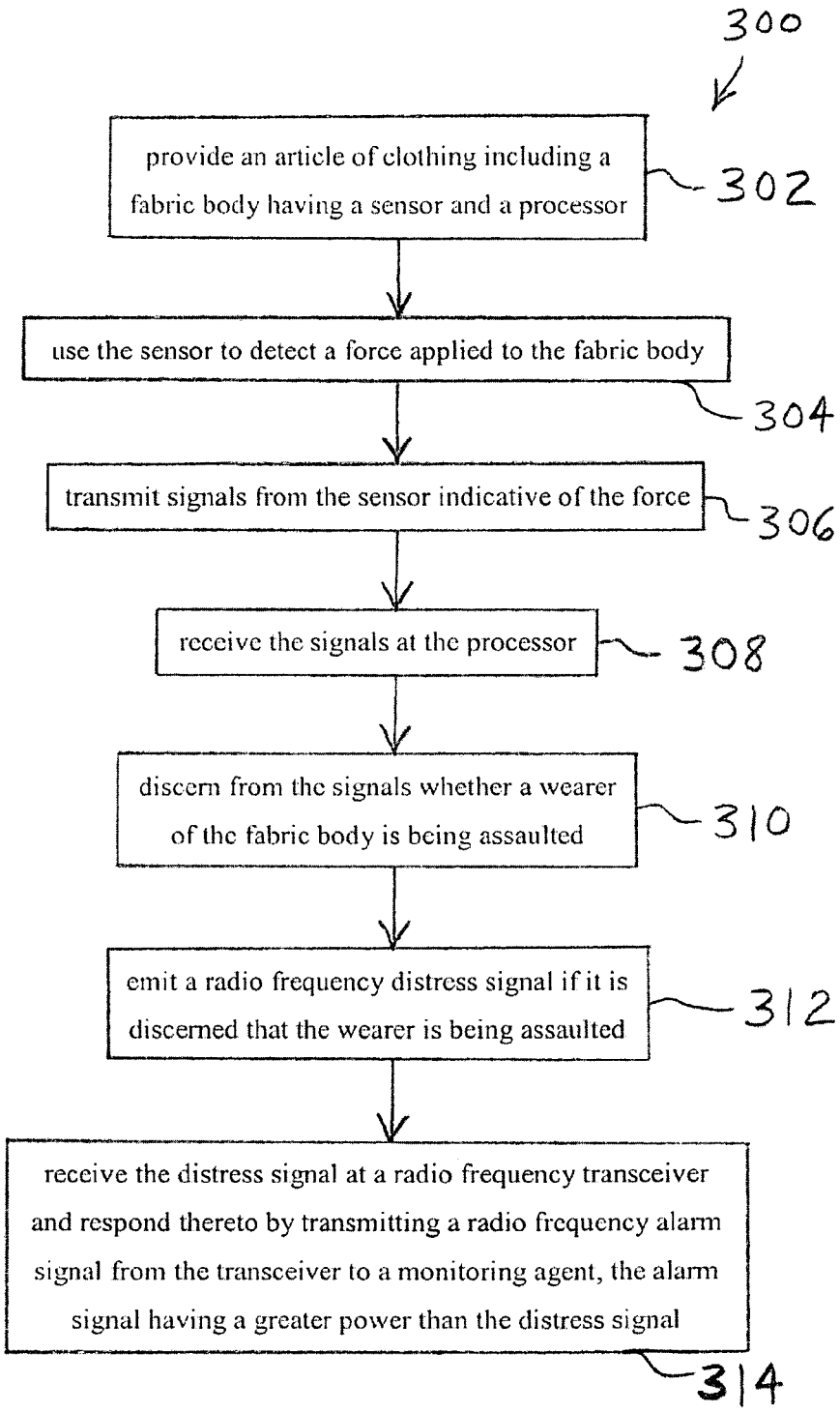
FIG. 3 is a flow chart illustrating one embodiment of a personal alarm method of the present invention.

Illustrated in FIG. 3 is one embodiment of a personal alarm method 300 of the present invention. In a first step 302, an article of clothing including a fabric body having a sensor and a processor is provided. For example, as shown in FIG. 1, an article of clothing in the form of a shirt 12 including a fabric body 16 having sensors 32 and a processing electronics 20 is provided.

In a next step 304, the sensor is used to detect a force applied to the fabric body. In FIG. 1, sensors 32 are used to detect forces applied to fabric body 16, such as pulling forces, grabbing forces, twisting forces and/or striking forces.

Next, in step 306, signals from the sensor indicative of the force are transmitted. That is, processing electronics 20 may apply a voltage to sensors 32, and sensors 32 may transmit signals to processing electronics 20 indicative of the level of force applied to sensors 32. More particularly, electrical characteristics of sensors 32 may change with force applied thereto, and the changing electrical characteristics may in turn cause the current flow through sensors 32 to change. The transmitted signals from sensors 32 may be in the form of this current flow.

In step 308, the signals are received at the processor. That is the signals from sensors 32, such as the changing currents flowing through sensors 32, are received at processing electronics 20.

In a next step 310, it is discerned from the signals whether a wearer of the fabric body is being assaulted. For example, microcontroller 38 may analyze the signals from sensors 32 and utilize an algorithm and/or lookup tables to discern whether the forces applied to sensors 32 are indicative of the human wearer of fabric body 16 being assaulted.

Next, in step 312, a radio frequency distress signal is emitted if it is discerned that the wearer is being assaulted. That is, if microcontroller 38 analyzes the signals from sensors 32 and decides that the human wearer of shirt 12 is being assaulted, then low power RF transmitter 40 emits radio frequency distress signal 44.

In a final step 314, the distress signal is received at a radio frequency transceiver and the RF transceiver responds thereto by transmitting a radio frequency alarm signal from the transceiver to a monitoring agent. The alarm signal has a greater power than the distress signal. For instance, distress signal 44 may be received at RF transceiver 14, and transceiver 14 may respond thereto by transmitting an RF alarm signal 46 from transceiver 14 to monitoring agent 48. Alarm signal 46 may have a greater power the distress signal 44. In various embodiments, distress signal 44 has a transmission range of less than one mile, and in other embodiments, distress signal 44 has a transmission range of less than one-half mile, less than one-quarter mile, and less than one-eighth mile, respectively. Alarm signal 46, in contrast, may have a transmission range of at least five miles such that alarm signal 46 has a high probability of being received by a police radio or a military radio. In the case of transceiver 14 being in the form of a cell phone, the cell phone may have a transmission range of approximately between five and eight miles such that the transmission may reach the nearest cell site.

Article of clothing 10 has been illustrated herein as being in the form of a shirt. However, it is to be understood that article of clothing 10 could alternatively be in the form of any type of clothing, such as pants, a jacket, a coat, underwear, or a dress, for example. Further, the present invention may be applied to personal items other than clothing. For instance, in another embodiment, a series-connected string of force sensors is included in the strap of a purse such that if a purse snatcher were to pull the purse out of the owner's grip on the strap, the unusually high measured force causes a duress signal to be transmitted by the low power RF transmitter, and the RF transceiver responds by transmitting an alarm signal to the monitoring agent.

In the specific embodiment shown in FIG. 1, sensors 32 are shown as being disposed on only circular pad 34. However, in other embodiments, sensors 32 are dispersed throughout the article of clothing. Moreover, sensors 32 may not be mounted on a pad or other backing, but rather may be supported by the fabric material of the article of clothing itself.

As described above, a battery may be provided in processing electronics 20. However, in another embodiment, a battery may be included with sensor matrix 18 or may be provided on a portion of fabric body 16 away from either of processing electronics 20 or sensor matrix 18. In a particular embodiment, one or both of processing electronics 20 and the battery are disposed within hem 28 of fabric body 16, such as below a seam line 50 (FIG. 1). Such placement of processing electronics 20 and the battery may serve to better conceal processing electronics 20 and the battery, especially if hem 28 is tucked into the wearer's pants. Providing processing electronics 20 and the battery in bottom hem 28 may also serve to weigh down the bottom of fabric body 16, which may help to straighten out fabric body 16 and give it a tidy, unwrinkled appearance. Moreover, positioning processing electronics 20 as low as possible on fabric body 16 has the additional advantage of reducing the distance between low power RF transmitter 40 of electronics 20 and an RF transceiver in the form of a cell phone 14 in a wearer's pants pocket. Such reduction in the distance between RF transmitter 40 and RF transceiver 14 may reduce the transmission power requirements of RF transmitter 40, thereby extending the useful life of the battery and/or reducing the size of the battery that is required.

The present invention has been described herein as being used to sense a physical attack by another human being. However, in other embodiments, the present invention may be used to sense a physical attack by an animal, or may be used to sense that the wearer has been involved in an accident. Thus, the invention may be equally useful to hunters, animal care takers, construction workers, vehicle drivers, hikers, or anyone who partakes in a physically dangerous or solitary activity.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An article of clothing, comprising:

a fabric body;

a directional sensor attached to the fabric body and configured to detect forces applied to the fabric body; and a processor attached to the fabric body and communicatively coupled to the directional sensor, the processor being configured to:

receive signals from the directional sensor;

analyze the signals and discern therefrom whether a physical attack is occurring on a wearer of the fabric body and, based on the information from the directional sensor, to identify a direction in which the forces are applied to the fabric body; and emit a distress signal to a radio frequency transceiver carried by the wearer if it is discerned that the attack is occurring, wherein the radio frequency transceiver responds to the distress signal by transmitting a radio frequency alarm signal to a monitoring agent, the alarm signal having a greater power than the distress signal.

2. The article of clothing of claim 1 wherein the processor includes a signal conditioning circuit and a microcontroller, the signal from the directional sensor being an analog sensor signal, the signal conditioning circuit being configured to convert the analog sensor signal to a digital sensor signal.

3. The article of clothing of claim 1 further comprising a matrix of sensors is attached to the fabric body, the processor being configured to discern from the signals from each sensor of the matrix of sensors whether a wearer of the fabric body is being physically attacked based at least in part on information from the directional sensor.

4. The article of clothing of claim 1 wherein the processor is configured to discern from the signals whether the fabric body is being grabbed or pulled based at least in part on information from the directional sensor.

5. The article of clothing of claim 1 wherein the directional sensor comprises at least one of a strain gauge, a transducer and a capacitive sensor.

6. The article of clothing of claim 1 wherein the distress signal has a transmission range of less than one mile.

7. The article of clothing of claim 1 wherein the fabric body comprises a shirt, the directional sensor being disposed on a front of the shirt, the processor being disposed on a lateral side of the shirt and adjacent to a bottom hem of the shirt.

8. A personal alarm arrangement, comprising:

a fabric body;

a directional sensor attached to the fabric body and configured to detect forces applied to the fabric body;

a processor attached to the fabric body and communicatively coupled to the directional sensor, the processor being configured to:

receive signals from the sensor;

discern from the signals whether a wearer of the fabric body is being assaulted and, based on the information from the directional sensor, to identify a direction in which the forces are applied to the fabric body; and emit a radio frequency distress signal if it is discerned that the wearer is being assaulted; and a radio frequency transceiver carried by the wearer configured to receive the distress signal and respond thereto by transmitting a radio frequency alarm signal to a monitoring agent, the alarm signal having a greater power than the distress signal.

9. The arrangement of claim 8 wherein the processor includes a signal conditioning circuit and a microcontroller, the signal from the directional sensor being an analog sensor signal, the signal conditioning circuit being configured to convert the analog sensor signal to a digital sensor signal.

10. The arrangement of claim 8 further comprising a matrix of sensors is attached to the fabric body, the processor being configured to discern from the signals from each sensor of the matrix of sensors whether a wearer of the fabric body is being assaulted.

11. The arrangement of claim 8 wherein the processor is configured to discern from the signals whether the fabric body is being grabbed or pulled.

12. The arrangement of claim 8 wherein the directional sensor comprises at least one of a strain gauge, a transducer and a capacitive sensor.

13. The arrangement of claim 8 wherein the distress signal has a transmission range of less than one mile.

14. The arrangement of claim 8 wherein the fabric body comprises a shirt, the directional sensor being disposed on a front of the shirt, the processor being disposed on a lateral side of the shirt and adjacent to a bottom hem of the shirt.

15. The arrangement of claim 13 wherein the radio frequency transceiver comprises a cellular mobile telephone, police radio and military radio.

16. A personal alarm method, comprising the steps of:

providing an article of clothing including a fabric body having a directional sensor and a processor;

using the directional sensor to detect a force applied to the fabric body;

transmitting signals from the directional sensor indicative of the force;

receiving the signals at the processor;

discerning from the signals whether a wearer of the fabric body is being assaulted and, based on the information from the directional sensor, to identify a direction in which the forces are applied to the fabric body;

emitting a radio frequency distress signal if it is discerned that the wearer is being assaulted; and receiving the distress signal at a radio frequency transceiver carried by the wearer and responding thereto by transmitting a radio frequency alarm signal from the transceiver to a monitoring agent, the alarm signal having a greater power than the distress signal.

17. The method of claim 16 wherein the processor includes a signal conditioning circuit and a microcontroller, the signal from the directional sensor being an analog sensor signal, the method including using the signal conditioning circuit to convert the analog sensor signal to a digital sensor signal.

18. The method of claim 16 wherein the article of clothing further includes a matrix of sensors, the discerning step including discerning from the signals from each of the sensors whether a wearer of the fabric body is being assaulted.

19. The method of claim 16 wherein the discerning step includes discerning from the signals whether the fabric body is being grabbed or pulled.

20. The arrangement of claim 8 wherein the transceiver is configured to be carried within a pants pocket of pants worn by the wearer.

* * * * *